United States Patent [19]

Stroszynski et al.

[11] Patent Number: 4,605,480

[45] Date of Patent: Aug. 12, 1986

[54] DEVICE FOR CONTINUOUSLY ANODICALLY OXIDIZING ALUMINUM STRIPS ON ONE SURFACE THEREOF AND USE OF THESE ALUMINUM STRIPS IN THE PRODUCTION OF OFFSET PRINTING PLATES

[75] Inventors: Joachim Stroszynski, Wiesbaden; Walter Niederstätter, Eltville; Gerhard Sprintschnik, Taunusstein, all of Fed. Rep. of Germany

[73] Assignee: Hoechst Aktiengesellschaft, Frankfurt am Main, Fed. Rep. of Germany

[21] Appl. No.: 704,313

[22] PCT Filed: Jun. 13, 1983

[86] PCT No.: PCT/EP83/00152

§ 371 Date: Feb. 13, 1985

§ 102(e) Date: Feb. 13, 1985

[87] PCT Pub. No.: WO84/04934

PCT Pub. Date: Dec. 20, 1984

[51] Int. Cl.[4] ..... C25D 17/00

[52] U.S. Cl. ..... 204/211

[58] Field of Search ..... 204/206, 211

[56] References Cited

U.S. PATENT DOCUMENTS

| | | | |
|---|---|---|---|
| 3,181,461 | 5/1965 | Fromson | 101/149.2 |
| 3,296,114 | 1/1967 | Lloyd | 204/206 |
| 3,359,189 | 12/1967 | Cooke et al. | 204/28 |
| 3,420,760 | 1/1969 | Freedman | 204/211 |
| 3,471,375 | 10/1969 | Cooke et al. | 204/28 |
| 3,632,486 | 1/1972 | Herrmann et al. | 204/33 |
| 3,692,640 | 9/1972 | Hamabe et al. | 204/28 |
| 3,718,547 | 2/1973 | Cooke et al. | 204/28 |
| 3,766,043 | 10/1973 | Herrmann et al. | 204/207 |
| 3,865,700 | 2/1975 | Fromson | 204/28 |
| 3,871,982 | 3/1975 | Idstein | 204/207 |
| 3,902,976 | 9/1975 | Walls | 204/38 A |
| 3,959,090 | 5/1976 | Hoellrigl et al. | 204/28 |
| 4,211,619 | 7/1980 | Usbeck | 204/33 |
| 4,214,961 | 7/1980 | Anthony | 204/140 |
| 4,226,680 | 10/1980 | Cooke et al. | 204/28 |
| 4,248,674 | 2/1981 | Leyh | 204/211 |

FOREIGN PATENT DOCUMENTS

| | | | |
|---|---|---|---|
| 0007233 | 4/1982 | European Pat. Off. | 204/28 |
| 2619821 | 11/1977 | Fed. Rep. of Germany | 204/28 |
| 608557 | 9/1948 | United Kingdom | 204/28 |
| 1230447 | 5/1971 | United Kingdom | 204/28 |
| 1260505 | 1/1972 | United Kingdom | 204/28 |
| 2012305 | 7/1979 | United Kingdom | 204/28 |

*Primary Examiner*—T. M. Tufariello

*Attorney, Agent, or Firm*—Schwartz, Jeffery, Schwaab, Mack, Blumenthal & Evans

[57] ABSTRACT

In the process for continuously anodically oxidizing one surface of strips of aluminum or an aluminum alloy, a direct current is caused to act on the strips, by at least one anode and at least one cathode, which are arranged in an aqueous electrolyte. The anode(s) and cathode(s) electrochemically act, from opposite sides and simultaneously, on the strip which moves past them and which is, in particular, substantially horizontally conveyed past the substantially horizontally arranged electrodes.

A device for carrying out a process of this kind comprises (a) at least one treating bath (2) which is filled with an aqueous electrolyte (3), (b) at least one anode (5) each, which is arranged in the electrolyte, below the strip (1) to be treated, and (c) at least one cathode (4) each, which is arranged in the electrolyte, above the strip (1) to be treated.

A strip which has been treated in this manner is preferably used as a support material in the production of offset-printing plates which are provided with a radiation-sensitive coating.

11 Claims, 4 Drawing Figures

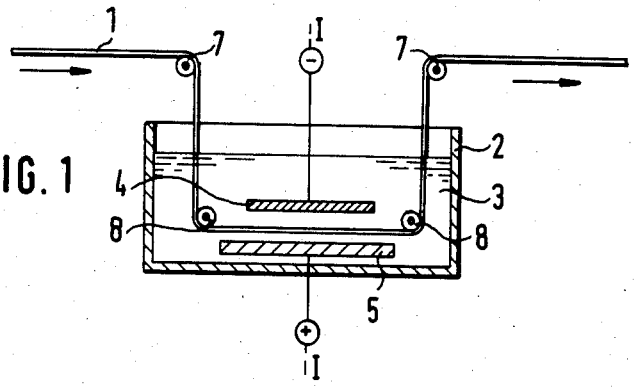
FIG. 1
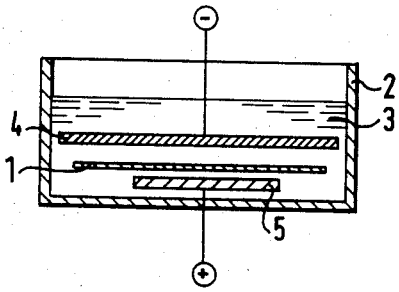
FIG. 2
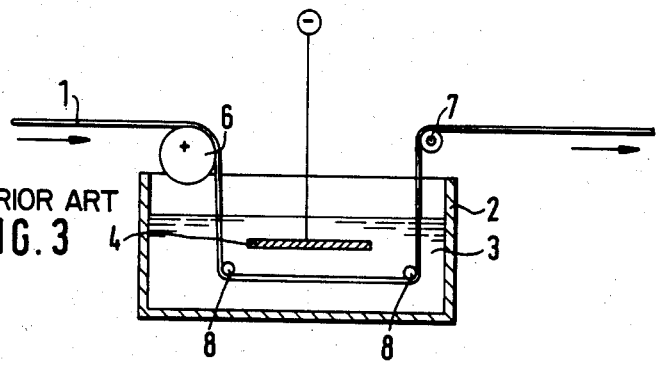
PRIOR ART
FIG. 3
PRIOR ART
FIG. 4
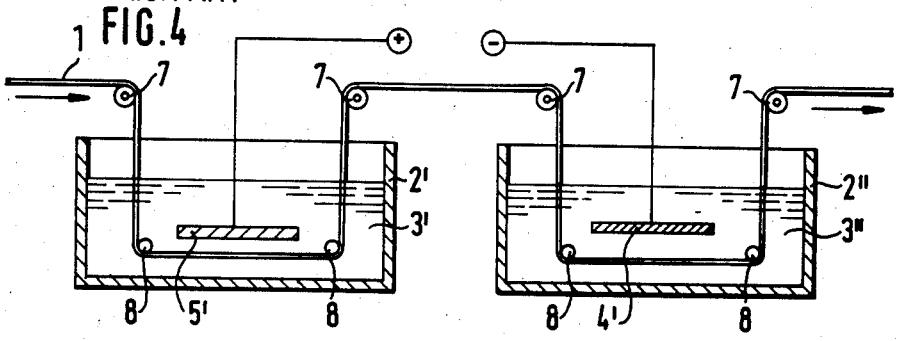

DEVICE FOR CONTINUOUSLY ANODICALLY OXIDIZING ALUMINUM STRIPS ON ONE SURFACE THEREOF AND USE OF THESE ALUMINUM STRIPS IN THE PRODUCTION OF OFFSET PRINTING PLATES

BACKGROUND OF THE INVENTION

The present invention is concerned with a process and a device for continuously anodically oxidizing one surface of a strip-shaped aluminum or aluminum alloy, which can particularly be used as a support material for offset-printing plates.

Strip-shaped aluminum which has been roughened and anodically oxidized is, for example, required for manufacturing electrolytic capacitors, in the building industry, for packaging materials, or in the production of support materials for offset-printing plates. For these purposes, the strip material is generally cut into smaller sizes.

Support materials for offset-printing plates are provided, on one or both sides, with a radiation-sensitive (photosensitive) coating (reproduction coating), which is applied either directly by the user or by the manufacturer of precoated printing plates and with the aid of which a printing image of an original is produced by a photomechanical route. Following the production of this printing form from the printing plate, the coating support comprises image areas which are ink-receptive in the subsequent printing process while, simultaneously with the image-production, a hydrophilic image-background for the lithographic printing operation is formed in the areas which are free from an image (non-image areas) in the subesequent printing process.

A coating support for reproduction coatings used in the manufacture of offset-printing plates must meet the following requirements:

Those portions of the radiation-sensitive coating, which are comparatively more soluble following exposure must be capable of being easily removed from the support by a developing operation, in order to produce the hydrophilic non-image areas without leaving a residue and without any stronger attack on the support material by the developer.

The support, which has been laid bare in the nonimage areas, must possess a high affinity for water, i.e., it must be strongly hydrophilic, in order to accept water, rapidly and permanently, during the lithographic printing operation, and to exert an adequate repelling effect with respect to the greasy printing ink.

The radiation-sensitive coating must exhibit an adequate degree of adhesion prior to exposure, and those portions of the coating which print must exhibit adequate adhesion following exposure.

The support material should possess good mechanical stability, for example with respect to abrasion, and good chemical resistance, especially with respect to alkaline media.

As the base material for coating supports of this kind, aluminum is particularly frequently used, the surface of this aluminum being roughened, according to known methods, by dry-brushing, slurry-brushing, sandblasting, or by chemical and/or electrochemical treatments. In order to increase the resistance to abrasion, especially electrochemically roughened substrates are additionally subjected to an anodizing step, in order to build up a thin oxide layer. These anodic oxidation processes are conventionally carried out in aqueous electrolytes which contain $H_2SO_4$, $H_3PO_4$, $H_2C_2O_4$, $H_3BO_3$, amidosulfonic acid, sulfosuccinic acid, sulfosalicylic acid or mixtures thereof. The oxide layers built up in these aqueous electrolytes or electrolyte mixtures differ from one another in structure, layer thickness and resistance to chemicals. As already mentioned above, roughened and anodically oxidized materials of this type are of some importance also in other technical fields. In the commercial production of supports for offset-printing plates, aqueous solutions of $H_2SO_4$ and/or $H_3PO_4$ are, in particular, used.

The prior art has disclosed the following devices and/or processes for continuously anodically oxidizing aluminum strips in a technically appropriate procedure. These devices and/or processes can fundamentally be divided into two groups:

1. The aluminum strip is made the anode by means of a contact roll (contact roller or contact bar) which is positioned outside the anodizing electrolyte and is connected to the positive pole of a d.c. supply. At least one cathode is arranged in the electrolyte and the aluminum strip is anodically oxidized on its surface which faces this electrode (see also FIG. 3 of the accompanying drawing).

2. The aluminum strip is made the anode by means of a contacting cell (contacting compartment) which is filled with an electrolyte and includes at least one anode. The strip itself is then passed as a center conductor into a second cell (compartment) filled with an electrolyte, in which at least one cathode is arranged (see also FIG. 4 of the accompanying drawing). In various variations of this arrangement, the sequence of cells (compartments) can be changed and it is also possible to use different electrolytes. The aluminum strip is anodically oxidized on that surface which faces the cathode.

The two variants 1 and 2 are, for example, described in DE-A No. 1,621,115 (=U.S. Pat. Nos. 3,632,468 and 3,766,043). Variant 1 or modifications of this variant are also disclosed in the following publications: DE-B No. 1,298,823 (=U.S. Pat. No. 3,296,114) including contacting electrode blocks outside the compartment which is filled with an electrolyte; DE-B No. 1,906,538 (=GB-A No. 1,260,505) having a contact-making brush outside the anodizing chamber; DE-C No. 2,045,787 (=U.S. Pat. No. 3,692,640) comprising a contacting electrolyte stream which is ejected from a hollow cathode device provided with openings, however, this publication does not clearly specify the kind of anodic connection; DE-C No. 2,234,424 (=U.S. Pat. No. 3,871,982) or DE-A No. 2,619,821, including, in each case, a contact roll outside the anodizing chamber.

Variant 2 or modifications of this variant are also disclosed in the following publications: DE-B No. 1,496,714 (=U.S. Pat. Nos. 3,471,375 and 3,359,189) comprising anode(s) disposed in a contacting and cleaning compartment filled with an electrolyte, which is arranged upstream of the anodizing compartment equipped with cathode(s), which is likewise filled with an electrolyte and in which the electrolyte flow is counter to the direction of travel of the aluminum strip; DE-A No. 2,156,677 (=U.S. Pat. No. 3,718,547) comprising a similar arrangement which additionally includes a downstream electrolyte-filled contacting compartment equipped with anode(s); DE-A No. 2,420,704 (=U.S. Pat. No. 3,865,700), in which the sequence of cells is reversed, i.e. the anodizing cell provided with a cathode is followed by the contacting cell provided with an anode; DE-B No. 2,507,063 (=U.S. Pat. No. 4,226,680) or DE-C No. 2,534,028 (=U.S. Pat. No. 3,959,090) including an anodic-oxidation stage and a coloring stage, in which the first stage also comprises a contacting compartment with anode(s) and an anodizing compartment with cathode(s); DE-A No. 2,853,609 (=GB-A No. 2,012,305) including anode(s) in a contacting compartment and cathode(s) in an anodizing compartment, in which the contacts of the cathodes show a specific predetermined arrangement; EP-B No. 0,007,233 comprising an anode in a contacting cell filled with an aqueous solution of $H_3PO_4$ and a cathode in an anodizing cell filled with an aqueous solution of $H_2SO_4$.

Variant 1 has the following disadvantages: The aluminum strip must be as dry as possible when it makes contact with the contact roll—notwithstanding preceding treatment steps in solutions, which are normally carried out—and, therefore, additional costs of construction and energy are required for an intermediate drying process. In addition, arc discharges may occur, when the strip is separated from the contact roll and these arc discharges can irreversibly destroy the surface of the aluminum strip and give rise to faults in the subsequent anodic oxidation or even render the strip entirely useless. In view of the high operating speeds currently demanded, for example, of 300 m/min and even higher, in connection with the high current densities required in the process, these disadvantages can prove to be particularly detrimental. These disadvantages do not occur with variant 2, however, in this variant, use of a contacting cell or contacting compartment, respectively, results in an additional extension of the anodic-oxidation stage to almost twice its length, and this is very uneconomical at the required operating speeds which necessarily involve long electrolyte baths.

DE-A No. 2,917,383 (=U.S. Pat. No. 4,214,961) describes a process for continuously electrochemically treating (roughening or anodically oxidizing) aluminum strips, in a vertical arrangement. In the process, the aluminum strip is, in each case, passed vertically over idler rollers and between dividers arranged in an electrolytic bath, with at least part of these dividers being also electrodes. According to FIG. 4 of this publication, all the dividers may be connected to act as electrodes; if this is so, two adjacent dividers are, in each case, anodes or cathodes, respectively, and, as a result, the aluminum is treated on both surfaces. In this variant, the process cannot be used for treating aluminum on one surface and it also cannot be applied to a strip which is substantially horizontally guided.

SUMMARY OF THE INVENTION

It is an object of the present invention to provide a process and a device for continuously anodically oxidizing aluminum strips on one surface thereof, which make it possible to use electrolytic bath(s) of reasonable lengths in the actual anodizing compartment, without adversely influencing the strip surface, even in the case of high travelling speeds of the strip.

The invention is based on a process for continuously anodically oxidizing one surface of strips of aluminum or an aluminum alloy in an aqueous electrolyte, using a direct current which is caused to act on the aluminum strip by at least one anode and at least one cathode, which are arranged in the electrolyte. In the process of the invention, the anode(s) and the cathode(s) electrochemically act, from opposite sides and simultaneously, on the strip which moves past them. In preferred embodiments, the strip is substantially horizontally guided past the substantially horizontally arranged electrodes, the aqueous electrolyte contains sulfuric acid and/or phosphoric acid, and a mechanical, chemical and/or electrochemical roughening treatment is carried out before the anodic oxidation. The term "substantially horizontal" is meant to include angular deviations of even up to 30° from the horizontal line.

The object of the present invention is further achieved by a device for continuously anodically oxidizing one surface of strips of aluminum or an aluminum alloy, using a direct current, the device comprising (a) at least one treating bath filled with an aqueous electrolyte, (b) at least one anode each, which is arranged in the electrolyte, below the strip to be treated and (c) at least one cathode each, which is arranged in the electrolyte, above the strip to be treated. In a device according to the invention, only one treating bath may be provided, however, it is also possible to use several sequentially arranged treating baths, each of which comprises at least one of the above-specified pairs of electrodes; the baths may contain the same aqueous electrolyte, but it is also possible to employ different aqueous electrolytes. In the process, the strip which is to be treated can be introduced into the bath and/or removed from the bath and conveyed through the bath, respectively, by means of guide rollers (guide rolls), as is known in the art; different methods of transporting the strip are, however, also possible, for example, introducing the strip into the bath or removing it from the bath through sealed slots, or any of the other methods mentioned in the above-described state of the art.

In preferred embodiments of the device according to the invention, the width of an anode is smaller and the width of a cathode is greater than the width of the strip and the length of an anode exceeds the length of a cathode. The term "length" refers to the extension of the respective electrode surface in the direction of transportation of the strip and "width" is the extension of the electrode surface, normal to the direction of transportation of the strip.

The strip which is to be treated does not contact the electrode surface in the process, preferably, the strip is closer to the anode than to the cathode. As a rule, the terms "anode" or "cathode" or "electrode" refer to an electrically conducting body comprising one piece; other arrangements are, however, also possible, in which the electrically conducting body comprises several partial bodies, such that, for example, several partial anodes which are connected to the same pole of a source of current are arranged opposite a one-piece cathode in a treating bath. The relative dimensions given above, therefore, do not only refer to one-piece electrodes, but correspondingly also to an electrode comprising several partial bodies. Suitable aqueous electrolytes include those which are known from the state of the art (see also introductory part of the description), i.e. in particular aqueous solutions of $H_2SO_4$ or $H_3PO_4$, but also oxalic acid, chromic acid etc, mixtures of these acids or two or more baths comprising different electrolytes. The acid concentrations are usually between 2 and 60% by weight, the temperature of the electrolyte ranges from 5° to 60° C., the current densities of the direct current or the modified forms of direct current which are to be applied are between 0.5 and 150 $A/dm^2$ and the anodizing times are between 5 and 240 s. The layer weights of aluminum oxide are in the range from 0.5 to 10 $g/m^2$, which corresponds to a thickness of layer of about 0.15 to 3.0 μm. Preferably, the process according to the invention is carried out in such a way that the aqueous electrolyte is conveyed parallel in respect to the surface of the strip which is to be treated, for example, at a speed of 5 to 100 cm/s, the direction of flow of the electrolyte is, in particular, counter to the direction of transportation of the strip.

Suitable base materials for the material which is to be oxidized according to the present invention, include those of aluminum of an alloy thereof, which contains, for example, more than 98.5% by weight of Al and Si, Fe, Ti, Cu and Zn constituents. These aluminum strips are, optionally after pre-cleaning, roughened by mechanical (e.g. brushing and/or abrasive treatments) chemical (e.g. etchants) and/or electrochemical methods (e.g. treatment with an alternating current in aqueous HCl, $HNO_3$ and/or salt solutions). In the process of the invention, strips which have been subjected to electrochemical roughening or to a combination of mechanical and electrochemical roughening are especially used.

In a continuous procedure, the process parameters in an electrochemical roughening stage are generally within the following ranges: temperature of the electrolyte between 20° and 60° C., concentration of active substance (acid, salt) between 2 and 100 g/l (or even higher in the case of salts), current density between 15 and 250 A/dm$^2$, dwell time between 3 and 100 seconds and flow rate of the electrolyte measured on the surface of the workpiece to be treated between 5 and 100 cm/second; the type of current used is in most cases alternating current, however, it is also possible to use modified current types, e.g. an alternating current with different amplitudes of current strength for the anode and cathode current. The mean peak-to-valley roughness $R_z$ of the roughened surface is in the range from about 1 to 15 μm. The peak-to-valley roughness is determined according to DIN 4768, October 1970 edition, the peak-to-valley roughness $R_z$ then being the arithmetic mean calculated from the individual peak-to-valley roughnesses of five contiguous individual measurement lengths.

Pre-cleaning comprises, for example, treatment in an aqueous NaOH solution with or without a degreasing agent and/or complexing agents, trichloroethylene, acetone, methanol or other so-called aluminum pickles, which are commercially available. An etching treatment may additionally be carried out after roughening or, in the case of several roughening stages, even between the individual stages and in this treatment particularly at most 2 g/m$^2$ of material are removed (between the stages even up to 5 g/m$^2$); as the solutions with an etching action, aqueous alkali-metal hydroxide solutions or aqueous solutions of salts which have an alkaline reaction or aqueous acid solutions on a basis of $HNO_3$, $H_2SO_4$ or $H_3PO_4$ are generally used. In addition to an etching treatment stage between the roughening stage and the stage of an anodic oxidation, non-electrochemical treatments are also known, which merely have a rinsing and/or cleaning action and serve, for example, to remove deposits ("smut") which have formed in the roughening procedure or simply to remove electrolyte residues; for these purposes, dilute aqueous alkali-metal hydroxide solutions or water are, for example, employed.

The anodic-oxidation stage of the aluminum strip is optionally followed by one or more post-treating stages. Post-treating is particularly understood as a hydrophilizing chemical or electrochemical treatment of the aluminum oxide layer, for example, an immersion treatment of the strip in an aqueous solution of polyvinyl phosphonic acid, according to DE-C No. 1,621,478 (=GB-A No. 1,230,447), an immersion treatment in an aqueous solution of an alkalimetal silicate according to DE-B No. 1,471,707 (=U.S. Pat. No. 3,181,461), or an electrochemical treatment (anodization) in an aqueous solution of an alkali metal silicate according to DE-A No. 2,532,,769 (=U.S. Pat. No. 3,902,976). These post-treatment stages serve, in particular, to improve even further the hydrophilic character of the aluminum oxide layer, which is already sufficient for many fields of application, with the other well-known properties of the layer being at least maintained.

The strips prepared according to the present invention are particularly used as supports in the production of offset-printing plates, i.e. a radiation-sensitive coating is applied to one or both sides of the support material, either by the manufacturer of presensitized printing plates or directly by the user. Suitable radiation-sensitive (photosensitive) coatings basically comprise any coatings which, after irradiation (exposure), optionally followed by development and/or fixing, yield a surface in image configuration, which can be used for printing.

In addition to the coatings containing silver halides, which are used in many fields, various other coatings are also known, such as those described, for example, in "Light-Sensitive Systems", by Jaromir Kosar, puolished by John Wiley & Sons, New York, 1965: Colloid coatings containing chromates and dichromates (Kosar, Chapter 2); coatings containing unsaturated compounds, in which, upon exposure, these compounds are isomerized, rearranged, cyclized, or crosslinked (Kosar, Chapter 4); coatings containing compounds which can be photopolymerized, which, upon exposure, undergo polymerization of the monomers or prepolymers, optionally with the aid of an initiator (Kosar, Chapter 5); and coatings containing o-diazoquinones, such as naphthoquinonediazides, p-diazoquinones, or condensation products of diazonium salts (Kosar, Chapter 7). Other suitable coatings include the electrophotographic coatings, i.e. coatings which contain an inorganic or organic photoconductor. In addition to the photosensitive substances, these coatings can, of course, also contain other constituents, such as for example, resins, dyes or plasticizers. Concerning the types of radiation-sensitive coatings which can advantageously be employed DE-A No. 2,811,396 (=U.S. Pat. No. 4,211,619) is, for example, referred to.

The coated offset-printing plates which are obtained from the strips prepared according to the present invention are converted into the desired printing forms in a known manner, by imagewise exposure or irradiation, and rinsing the non-image areas with a developer, preferably an aqueous developing solution.

BRIEF DESCRIPTION OF THE DRAWINGS

The accompanying drawing shows an example of an embodiment of the device according to the invention, which is compared with two illustrative examples from the state of the art.

FIG. 1 shows a sectional lateral view of an anodizing device according to the present invention, FIG. 2 is a cross-sectional view of the device, along the line I—I of FIG. 1, FIG. 3 is a sectional lateral view of an anodizing device according to the state of the art (variant 1), and FIG. 4 is a sectional lateral view of an anodizing device according to the state of the art (variant 2).

DETAILED DESCRIPTION OF PREFERRED EMBODIMENTS

The aluminum strip 1 (FIGS. 1 and 2) which has previously been roughened is passed over a roller 7 to introduce it into the treating bath 2 which is filled with the aqueous electrolyte 3 (for example, an aqueous $H_2SO_4$ solution). Further changes in the direction of transportation of the strip 1 are effected by additional rollers 7 and 8. The strip 1 is horizontally guided between the horizontally arranged electrodes 4 and 5. The electrodes 4 and 5 have the shape of a plate or a grid; the cathode 4 is, for example, made of lead, while the anode 5 comprises aluminum or titanium which is modified with a noble metal or an oxide of a noble metal.

Compared with the device of the present invention, variant 1 according to the state of the art (FIG. 3) comprises an anode 6 which is arranged outside the aqueous electrolyte and has the shape of a roller, a bar, or a roll. In variant 2 according to the state of the art (FIG. 4), the anode 5' is arranged in a first treating bath 2' and the cathode 4' is in a second treating bath 2'', the two baths being filled with identical or different aqueous electrolytes 3' and 3''.

The process and the device according to the present invention therefore do not only have the advantage that the disadvantages of an anode arranged outside the electrolyte are non-existent, but there is, in particular, the advantage of saving a considerable amount of space and investment cost required for the secondary electrolyte bath(s). It is, above all, surprising that this last-mentioned advantage is not gained at the expense of surface quality, the more so since the prior art specifically only considers and refers to variants 1 and 2.

In the examples which follow, parts by weight are related to parts by volume as kg to $dm^3$, percentages refer to weight.

EXAMPLE 1

An electrochemically roughened aluminum strip having a width of 650 mm is anodically oxidized as follows.

As the anode which is arranged near the lower surface of the strip an aluminum sheet is used, which has a length of 6,000 mm, a width of 500 mm, and a thickness of 0.5 mm, and is wrapped with gauze which has a width of mesh of 0.2 mm, in order to protect the anode from being contacted by the strip moving along above it. The strip has a distance of 5 mm from the anode. Several smaller lead cathodes, the dimensions of which total 3,000 mm×1,000 mm×100 mm are arranged above the strip, at a distance of 50 mm. The electrolyte used comprises a 20% strength aqueous solution of $H_2SO_4$, which contains 1% of aluminum sulfate, the temperature is 40° C., the anodizing time 20 seconds and the current density 10 $A/dm^2$ (voltage 30 V). The oxide layer has a weight of 1.5 $g/m^2$.

After rinsing with water and drying, the aluminum strip is coated with the following positive-working light-sensitive composition:

0.6 part by weight of the esterification product obtained from 1 mole of 2,2'-dihydroxy-dinaphthyl-(1,1')-methane and 2 moles of the chloride of naphthoquinone-(1,2)-diazide-(2)-5-sulfonic acid, 1.0 part by weight of the 4-(2-phenyl-prop-2-yl)-phenolester of naphthoquinone-(1,2)-diazide-(2)-4-sulfonic acid, 7.5 parts by weight of novolac resin, 0.1 part by weight of crystal violet base, 0.3 part by weight of the chloride of naphthoquinone-(1,2)-diazide-(2)-4-sulfonic acid, and 90 parts by volume of ethylene glycol monoethyl ether.

The coating weight is about 2 $g/m^2$. For the production of a printing form, samples are exposed in a known manner and developed with an aqueous-alkaline solution. A printing form so prepared yields about 150,000 to 200,000 printed copies of technically appropriate quality.

EXAMPLE 2

In order to simulate the continuous procedure under various conditions, a grid anode (120 mm×80 mm) comprising platinized titanium and a cathode comprising a lead plate (100 mm×100 mm) are arranged in a trough filled with the electrolyte according to Example 1, at a distance of 80 mm from each other. An aluminum sheet which has a width of 90 mm is immersed into the electrolyte between the anode and the cathode, so that it is closer to the anode than to the cathode. At a current density of 15 $A/dm^2$ (voltage 14 V) and a temperature of 50° C., the aluminum sheet is anodically oxidized for 60 seconds. The oxide layer has a weight of 3.6 $g/m^2$.

EXAMPLE 3

Example 2 is repeated, however, in this case the anode comprises a titanium grid which is coated with an activated noble-metal oxide ($RuO_2$). The results obtained correspond to those of Example 2.

EXAMPLE 4

Example 2 is repeated, however, in this case the anode used is a solid aluminum sheet; the voltage rises from 14 to 26 V. The results obtained correspond to those of Example 2.

EXAMPLE 5

Example 2 is repeated, however, in this case a 10% strength aqueous solution of $H_3PO_4$ is used as the electrolyte, at a temperature of 55° C. and a current density of 10 $A/dm^2$ (voltage 30 V). The results obtained correspond to those of Example 2.

We claim:

1. A device for anodically oxidizing a surface of an aluminum or aluminum alloy strip, comprising:

(a) at least one treating bath containing an aqueous acid electrolyte;

(b) at least one anode positioned in said electrolyte;

(c) at least one cathode positioned in said electrolyte in spaced relationship to said at least one anode, the electrolyte surrounding said anode and the electrolyte surrounding said cathode being in continuous contact;

(d) means for applying a direct current to said anode and said cathode; and (e) means for conveying an aluminum or aluminum alloy strip between said anode and said cathode;

wherein a width of said anode perpendicular to a direction of conveyance of said strip is smaller than a width of said strip, and wherein a width of said cathode perpendicular to said direction of conveyance of said strip is larger than said width of said strip.

2. A device as claimed in claim 1, wherein a length of said anode parallel to said direction of conveyance of said strip is greater than a length of said cathode parallel to said direction of conveyance of said strip.

3. A device as claimed in claim 1, wherein said means for conveying said strip includes passing said strip continuously between said anode and said cathode without said strip contacting said anode or said cathode.

4. A device as claimed in claim 3, wherein said strip is closer to said anode than to said cathode.

5. A device as claimed in claim 1, wherein said electrolyte comprises surfuric acid, phosphoric acid, oxalic acid or chromic acid.

6. A device as claimed in claim 1, wherein the concentration of said aqueous acid electrolyte is from about 2% to about 60% by weight.

7. A device as claimed in claim 1, wherein the temperature of said aqueous acid electrolyte is from about 5° C. to about 60° C.

8. A device as claimed in claim 1, wherein the current density of said direct current is from about 0.5 to about 150 $A/dm^2$ and wherein said direct current is applied for a period of from about 5 and about 240 seconds.

9. A device as claimed in claim 1, wherein said strip, said anode and said cathode are completely submerged under a liquid level of said electrolyte.

10. A device as claimed in claim 1, wherein said electrolyte is sulfuric acid.

11. A device as claimed in claim 1, wherein said electrolyte is phosphoric acid.

* * * * *